US005558419A

United States Patent [19]

Dasher et al.

[11] Patent Number: 5,558,419

[45] Date of Patent: Sep. 24, 1996

[54] PULL-OUT FREEZER FLOOR FOR REFRIGERATOR AND FREEZERS

[75] Inventors: James F. Dasher, Vanderburgh County; Michael A. Fiori, Evansville, both of Ind.

[73] Assignee: Whirlpool Corporation, Benton Harbor, Mich.

[21] Appl. No.: 380,279

[22] Filed: Jan. 30, 1995

[51] Int. Cl.[6] ..... A47B 90/04

[52] U.S. Cl. ..... 312/404; 312/401; 312/405.1; 312/407; 312/407.1; 312/408; 312/330.1; 108/143; 211/151; 62/382

[58] Field of Search ..... 312/330.1, 401, 312/404, 405.1, 407, 407.1, 408, 334.14, 334.15, 334.16; 108/143; 211/151; 62/382

[56] References Cited

U.S. PATENT DOCUMENTS 2,376,032 5/1945 Clare .
2,682,754 7/1954 Eck .
2,719,772 10/1955 Petkwitz .
3,311,072 3/1967 Pattison ..... 211/151 X
3,984,163 10/1976 Boorman, Jr. et al. .
4,191,434 3/1990 Powell et al. .
4,944,157 7/1990 Jenkins et al. .
5,273,354 12/1993 Herrmann et al. .
5,299,863 4/1994 Albright, Jr. .

FOREIGN PATENT DOCUMENTS 5256564 11/1993 Japan ..... 62/382

*Primary Examiner*—Peter M. Cuomo
*Assistant Examiner*—Rodney B. White
*Attorney, Agent, or Firm*—Thomas J. Roth; Mark A. Davis

[57] ABSTRACT

A sliding platform for a cabinet for refrigerator and/or freezer having a stationary base secured to a floor of the cabinet and a sliding platform guided and facilitated for sliding by a plurality of loosely captured rollers between the platform and the base and prevented from tipping by anti-tip tabs. Both the platform and base have air entry air holes for delivering return air to an air passage beneath a top surface of the base.

17 Claims, 5 Drawing Sheets

PULL-OUT FREEZER FLOOR FOR REFRIGERATOR AND FREEZERS

BACKGROUND OF THE INVENTION

The present invention relates to domestic refrigeration devices, particularly to a stacked refrigerator/freezer cabinet, and in particular to a sliding shelf or floor installed into the cabinet.

Guided sliding shelves for freezers and refrigerators are generally known from U.S. Pat. Nos. 5,299,863 and 2,719,772.

In known refrigerator devices, a freezer compartment is divided horizontally with a wire shelf. This shelf allows the user to more conveniently organize items for later, easier access. Typically, one area that is difficult to access in a top mounted freezer is a rear portion of the area under the fixed wire shelf. In order to reach items in that area, it is necessary to move items out of the way, or to fully extend the user's arm to reach to the rear of the compartment.

SUMMARY OF THE INVENTION

It is an object of the present invention to provide a convenient storage system for a refrigerator and/or freezer. It is an object of the present invention to provide an extendable storage shelf or tray which allows for the circulation of cold air beneath the shelf notwithstanding items placed on the shelf. It is an object of the present invention to provide a two layer shelf system, a first layer being the extendable shelf or tray and the second layer being a base located below the extendable shelf, wherein each layer is capable of holding items and assuring proper cold air flow within the cabinet. It is an object that the first layer be removable from the second layer for cleaning. It is an object that the first layer provides an encircling wall, including portions of a back wall which are removable for cleaning the cabinet behind the first layer.

The objects are inventively achieved in that a pull-out, extendable tray assembly is provided to increase access to articles within the cabinet, particularly to an area under an intermediate wire shelf. The pull-out, extendable tray assembly provides a base and an overlying platform. In its retracted position, the tray assembly functions as a standard, fixed refrigerator or freezer floor. When the user desires access to the articles under the wire shelf, the platform of the tray assembly can be pulled and extended so that the items stored at the rear, on the platform, can be more easily accessed. When the user is finished, the platform is pushed back into place.

The base for the tray assembly performs many functions. It can function as a component of the air flow system of the refrigerator or freezer, ducting air from the front of the freezer compartment back to an evaporator mounted within an evaporator compartment behind the freezer compartment. In this regard, the base provides air openings at front end communicating into an air flow channel formed below the base to a rear end of the freezer compartment. The base provides a mounting system for drop-in rollers that support the platform of the tray assembly and provide smooth sliding movement. Slots in the rear of the base allow tip-up tabs on the platform to pass through the base and into proper position for operation. Longer slots allow the tabs to travel forward and engage the base, eliminating the possibility of the platform tipping up and falling out of the freezer as it travels forward on the front rollers. The base mounts to four screw anchors placed in a foamed-in place partition between the refrigerator and freezer compartments. Ribs placed on the bottom of the base support the base during operation and pass the load of the platform onto the partition and form an under base air flow passage.

On the platform, a front lip provides a handle to actuate the platform. Air return slots allow air to reach the duct formed by the base. The handle is raised in a vertical direction to help contain items stored on the platform. Swept ribs and access areas on either side of the front lip allow the user to wipe spills out of the product for easy cleaning. Structurally designed ribs and coated steel channels provide sufficient strength to resist downward deflection of the platform which might cause damage to other components of the refrigerator, or breakage of the platform itself. Rollers at the rear of the platform mounted to the coated steel channels prevent dragging of the platform as it is pushed backward. Detachable rear wall panels or "fences" at the rear of the upper platform prevent packages from sliding off the rear of the platform while it is extended and also allow access to the area behind the platform to remove any spills or objects that fall into the operational area of the extendable tray assembly. The platform of the extendable tray assembly is designed to be removed by the user for cleaning. The refrigeration system will function while the platform is removed. Objects can be stored on the base itself due to the design of the air openings in the base and the air flow channel of the base.

DETAILED DESCRIPTION OF THE PREFERRED EMBODIMENTS

Figure 1:
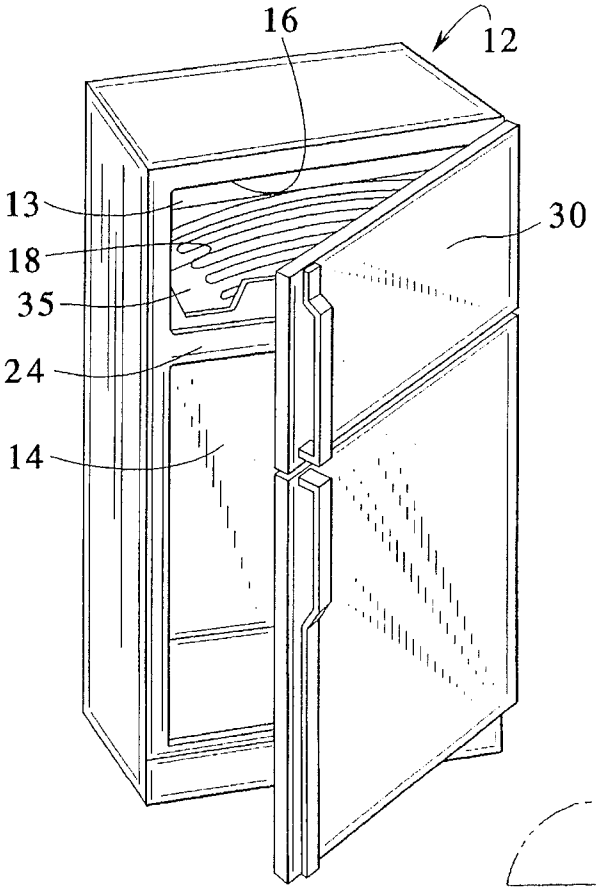
FIG. 1 is a perspective view of a refrigerator/freezer of the present invention.
Figure 2:
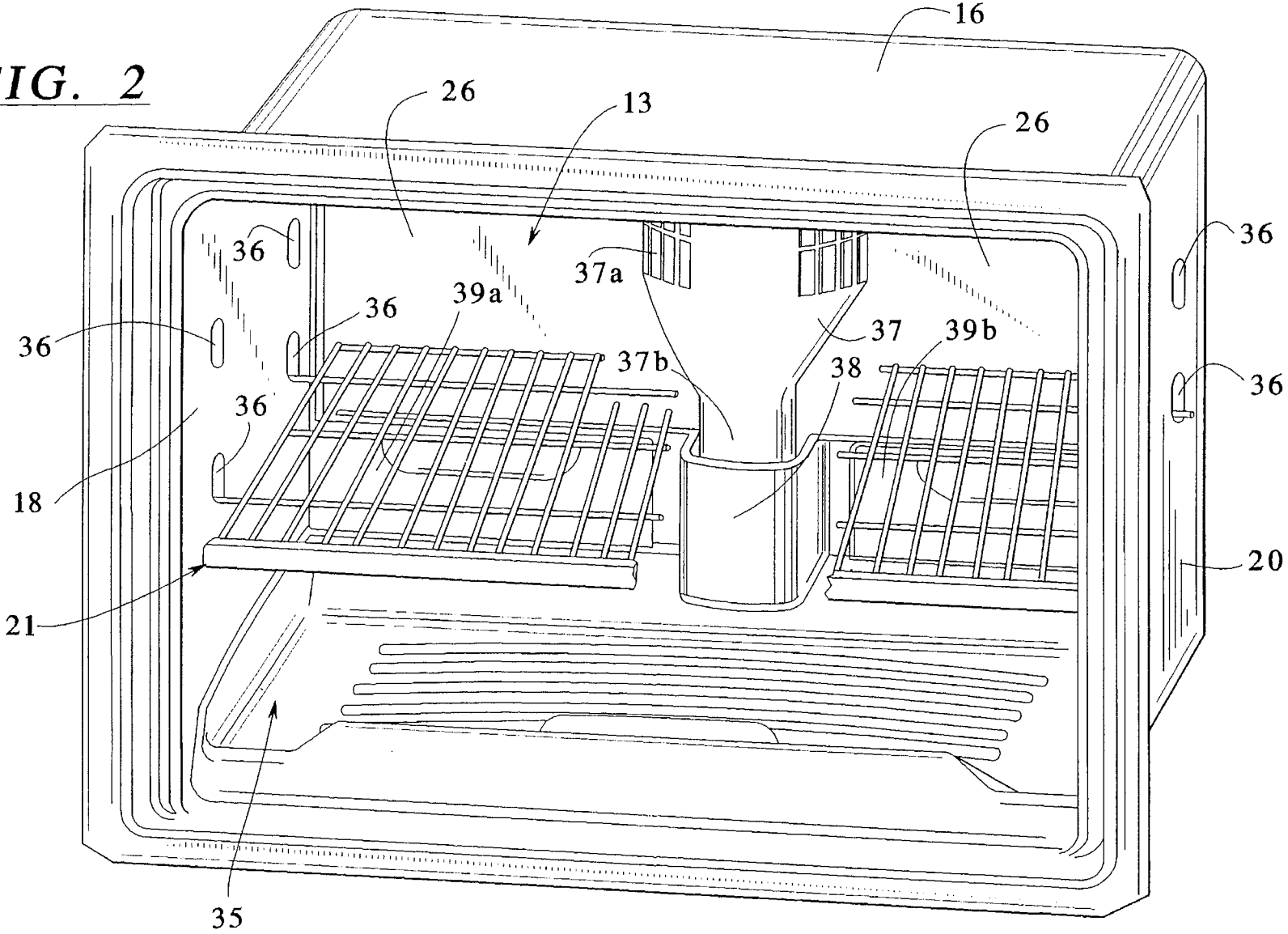
FIG. 2 is an enlarged perspective view of a freezer compartment of the refrigerator/freezer of FIG. 1.

FIG. 1 illustrates a stacked refrigerator/freezer 12 having a freezer compartment 13 above a refrigerator compartment 14. The freezer compartment 13 is also shown in FIG. 2 and is defined by a top wall 16, opposing side walls 18, 20, a partition or mullion 24, an evaporator cover 26 and an independently openable door 30. Mounted on the partition 24 is a slidable tray assembly 35. Although the slidable tray assembly 35 could also be used in a refrigerator compartment 14, the tray assembly 35 is particularly adapted for use on the partition 24 as the freezer compartment 13 is usually mounted at a less convenient elevation with a smaller volume to access than the refrigerator compartment 14. FIG. 2 illustrates holes 36 are applied in the sidewalls 18, 20 for holding a wire shelf 21 at selective elevations above the tray assembly 35. The slidable tray assembly is particularly advantageous for reaching items otherwise located beneath the wire shelf.

FIG. 2 shows the tray assembly 35 fit within the freezer compartment 13. The freezer compartment 13 provides an air tower 37 against the back wall 26. The air tower provides air vents 37*a* into the freezer compartment 13 for cold air circulation. The air tower also provides an air duct 37*b* for cold air circulation into the refrigerator compartment 14 below. The tray assembly 35 provides a U-shaped center back wall 38 for close fitment around the air duct 37*b*, and left and right removable fences 39*a*, 39*b* mounted vertically adjacent opposite sides of the center back wall 38.

Figure 3:
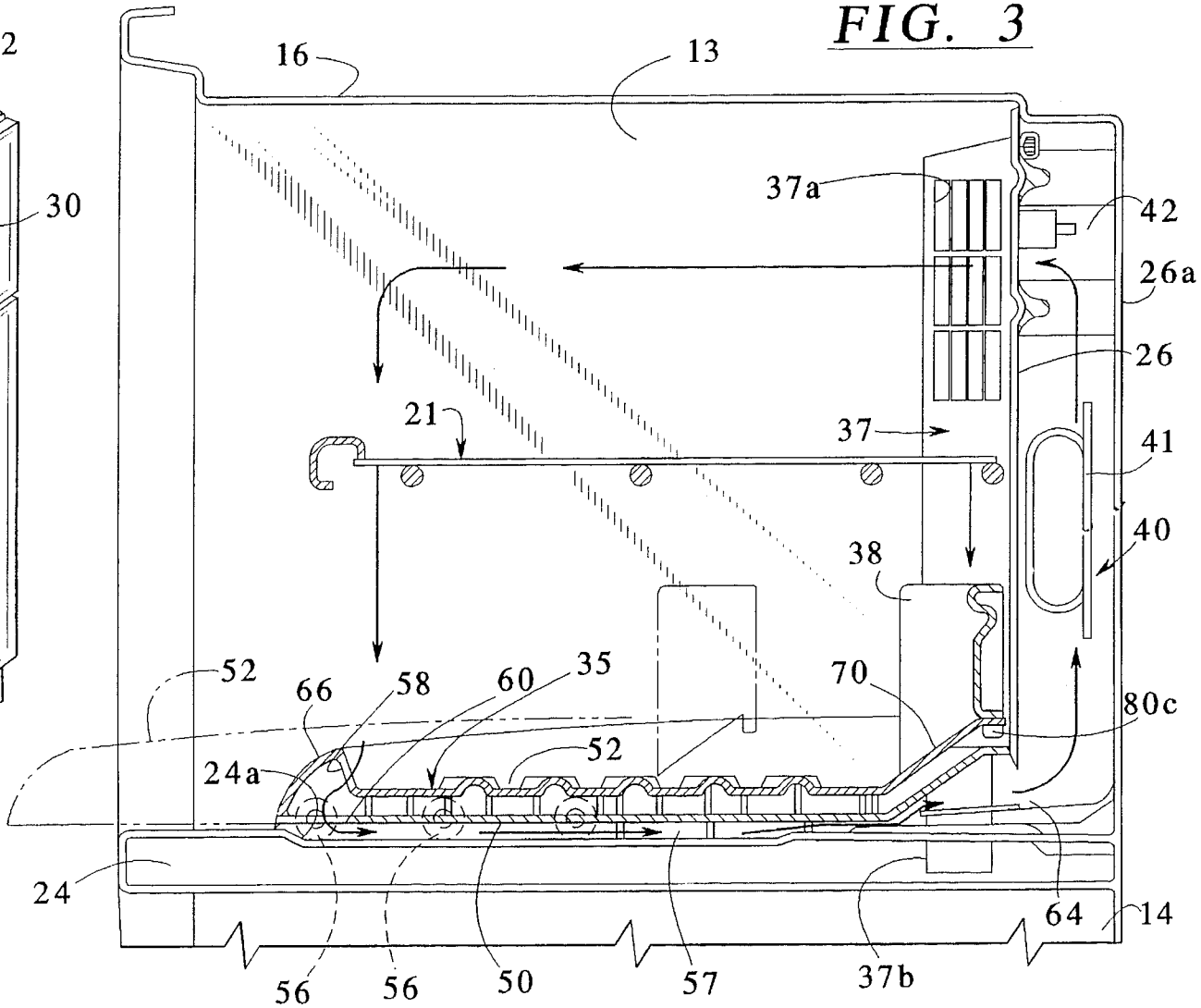
FIG. 3 is a sectional view taken generally along line III—III of FIG. 4.

FIG. 3 shows the compartment 13 defined in part by the top wall 16, the partition 24 and the back wall 26*a*. An evaporator compartment 40 is located between the evaporator cover 26 and a rear wall 26*a*. In the evaporator compartment 40 is mounted an evaporator 41 (shown schematically in FIG. 3) and an evaporator fan 42 which draws air through the evaporator 41 to cool the air and force the air through air openings 37*a* into the compartment 13 and through the air duct 37*b* into the compartment 14.

The tray assembly 35 is shown to have two major components, a base 50 upon which is slidably mounted a platform 52. The base 50 is inlaid into a recess 24*a* in the partition 24. A plurality of rollers 56 are allocated between the platform 52 and the base 50 to allow sliding movement of the platform 52 with respect thereto. As shown in this figure, an air flow passage 57 is provided between the tray assembly 35 and the partition 24 to allow air circulation from the compartment 13 to the evaporator 41. Air openings 58 are provided through the platform 52 which directs air through further openings 60 in the base which allows air to pass between the base 50 and the partition 24 in a rearward direction to an opening 64 below the evaporator cover 26 to allow air to pass to the evaporator 41. The openings 58 on the platform 52 are formed into a front lip 66 raised on the platform 52 which assists in retaining items on the platform 52 and provides a convenient handle for pulling the platform to its forward position (shown dashed), and pushing the platform to its retracted position.

Figure 4:
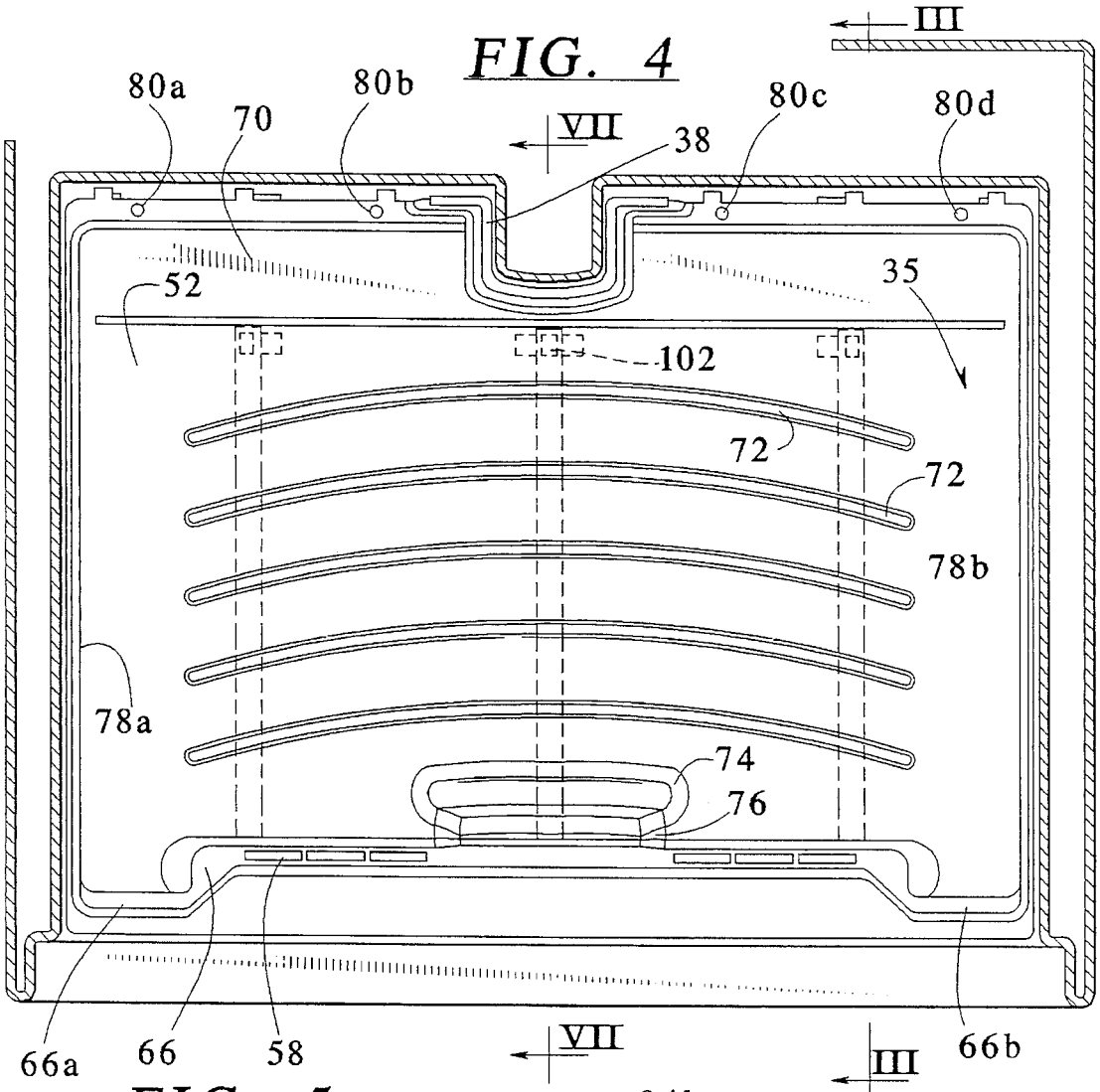
FIG. 4 is a partial plan view of the freezer compartment shown in FIG. 2.

FIG. 4 illustrates the tray assembly 35 which includes inclined back wall 70, platform 52, arcuate raised ribs 72 arranged spaced apart between the back wall 70 and the inclined front lip 66, raised package retainer 74 and finger recess 76 between the retainer 74 and the front lip 66. Side walls 78*a*, 78*b* connect the back wall 70 with the front lip 66. Sockets 80*a*, 80*b*, 80*c*, 80*d* are provided on a top surface of the back wall 70 to receive pegs 82, 84 (FIG. 6) arranged on bottom sides of the fences 39*a*, 39*b* to install the fences to the platform 52.

Figure 5:
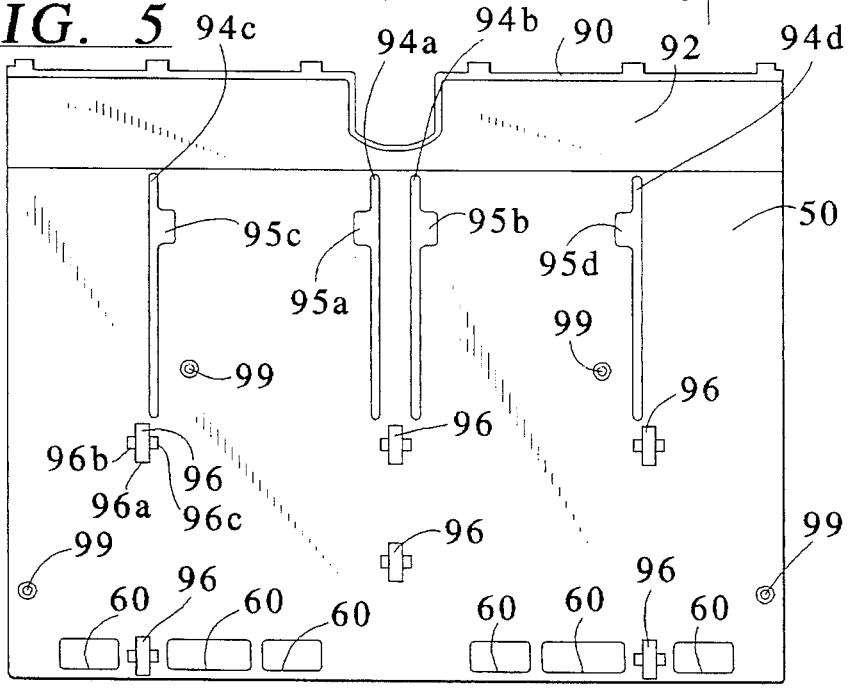
FIG. 5 is a plan view of a base arranged below a tray of the freezer compartment of FIG. 2.

FIG. 5 illustrates the base 50 of the present invention. The base provides a base back wall 90 and an inclined back ramp 92, center slots 94*a*, 94*b*, and left and right slots 94*c*, 94*d*. Each slot provides a wide portion 95*a,b,c,d* for receiving anti-tip tabs (described with regard to FIG. 9). Disposed on a front portion of the base 50 are six roller indents 96 each of which provide a central opening 96*a* and dished areas 96*b*, 96*c* on opposite sides of the central opening 96*a*. At a front side of the base 50 are arranged the air openings 60. A plurality of screws 99 pass through molded screw guides 99*a* (FIG. 10) and secure the base 50 to the partition 24.

Figure 6:
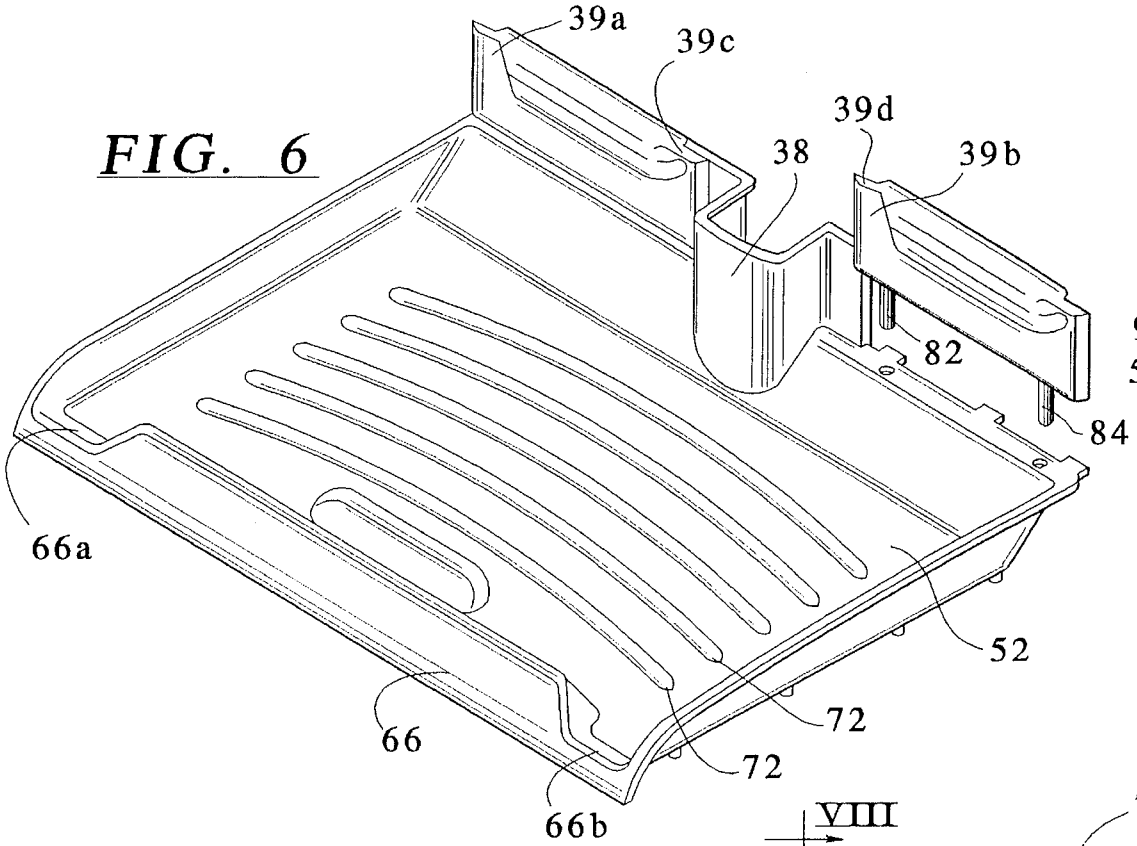
FIG. 6 is a perspective view of the pull-out tray of FIG. 1.

FIG. 6 shows the tray assembly 35 in perspective view and including trough regions 66*a*, 66*b* arranged on the front lip 66 which allows easy manual cleaning of the tray when removed. Also shown are the fences 39*a*, 39*b* with pegs 82, 84 for installation onto the platform 52. The pegs can be round in cross section as shown or can have a "cross" cross section such as a "+" sign, tapering slightly in a direction of insertion to assure a tight fit. The fences 39*a*, 39*b* have lips 39*c*, 39*d* which overlie the center wall 38 which also provides support to the fences. A flexible trim piece 67 is snap-fit to the front lip 66 to improve the cosmetic appearance of the tray assembly 35 and to cover the base 50 from view.

Figure 8:
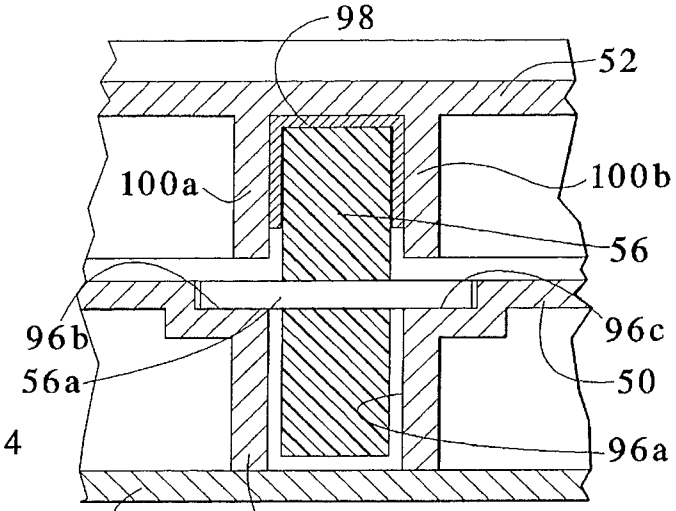
FIG. 8 is a sectional view taken generally along line VIII—VIII of FIG. 6.
Figure 7:
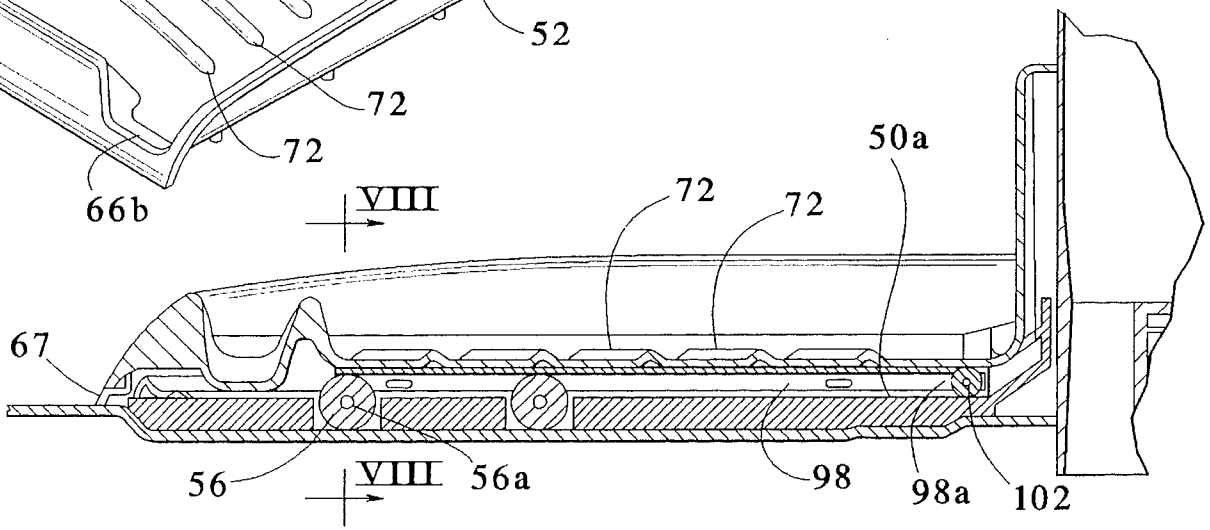
FIG. 7 is a sectional view taken generally along line VII—VII of FIG. 4.

FIGS. 7 and 8 illustrate the rollers 56 having molded-in axles 56*a* which interfit into the dished portions 96*b*, 96*c* formed in the base 50. The rollers 56 interfit into the opening 96*a* of the base 50 and guide a roller channel 98 which is attached to the platform 52 between walls 100*a*, 100*b* formed on the bottom of the tray platform 52. The roller channel 98 can be a coated steel channel. The opening 96*a* is formed by a rectangular cylinder 97 which also supports the platform 52 off the partition 24. At a back end 98*a* of the channels 98 are rotationally mounted surface rollers 102 which roll along a surface 50*a* of the base 50 during extension and retraction of the platform 52. The steel channels 98 provide a smooth surface for rolling contact with the rollers 56 and structurally reinforce the platform 52 against bending. The channels 98 can be adhesively secured to the platform or mechanically fastened.

Figure 9:
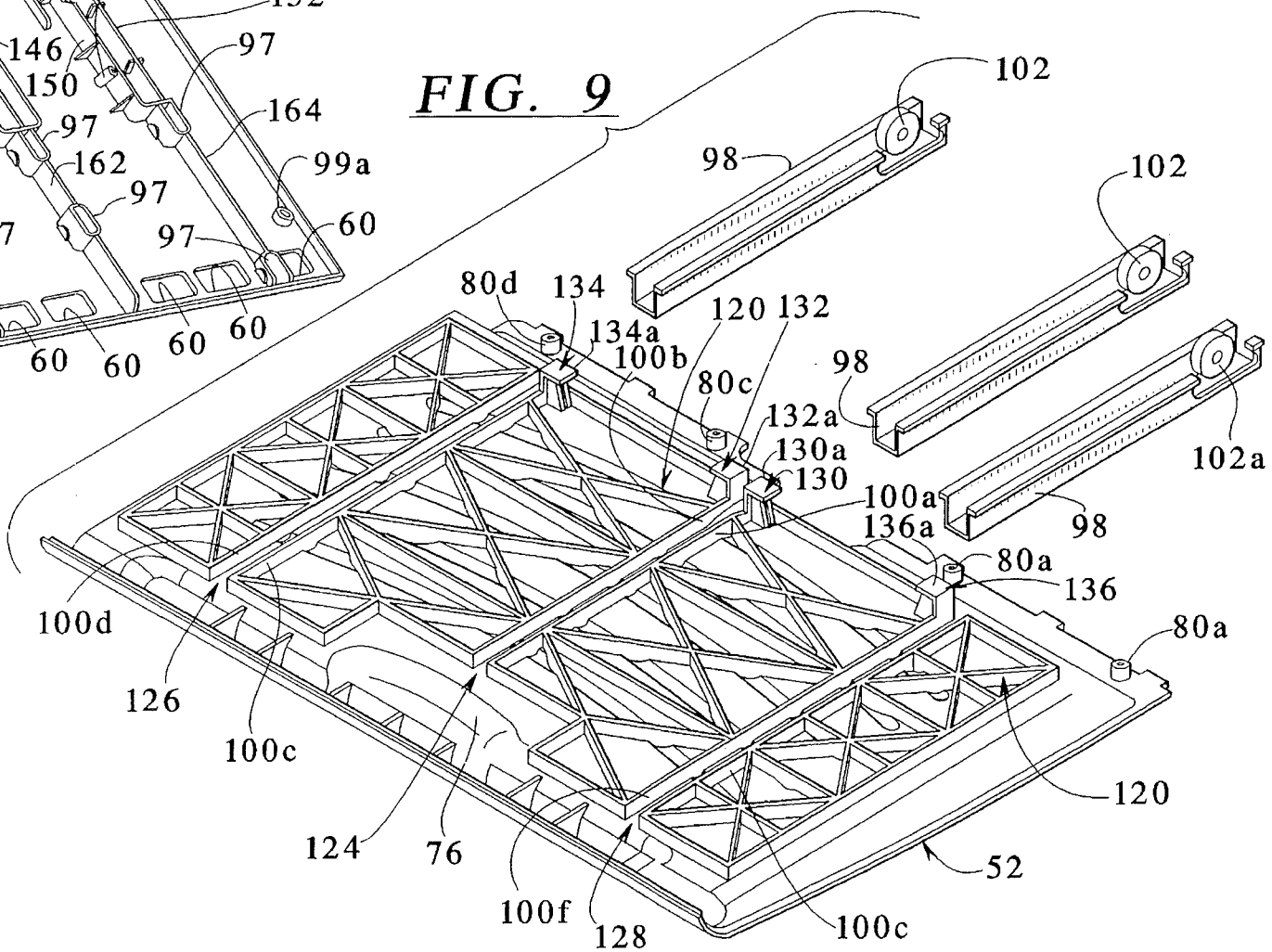
FIG. 9 is a perspective bottom view of the tray shown in FIG. 6.

FIG. 9 illustrates the underside structure of the tray platform 52. A plurality of criss-crossed reinforcing ribbing 120 is formed with the platform 52 to give the otherwise thin walled platform rigidity while maintaining a light weight. Three longitudinal channels 124, 126, 128 are provided defined by walls 100*a,b*; 100*c,d*; and 100*e,f* respectively. These channels each receive a roller channel 98 as described with respect to FIG. 8. At the back end 98*a* of each roller channel 98 is rotatably mounted the surface roller 102. An axle 102*a* can be carried by sidewalls of the channel 98. At a back end of the channel 124 are mounted anti-tip tabs 130,132 facing in opposite lateral directions. At a back end of the channel 126 is mounted an anti-tip tab 134 facing inwardly of the platform 52. At a back end of channel 128 is mounted an anti-tip tab 136 facing inwardly of the platform 52. The anti-tip tabs 130, 132, 134, 136 fit into the wide slot portions 95*a*, 95*b*, 95*d*, 95*c* (FIG. 5) respectively when the platform 52 is mounted, at approximately 1" forward of the fully retracted position, to the base 50. When the platform 52 is extended forwardly the anti-tip tabs pass through the slots 94*a,b,c,d* with a head portion 130*a*, 132*a*, 134*a*, 136*a* captured beneath the base 50, which prevents disengagement between the platform and base at the extended position.

Figure 10:
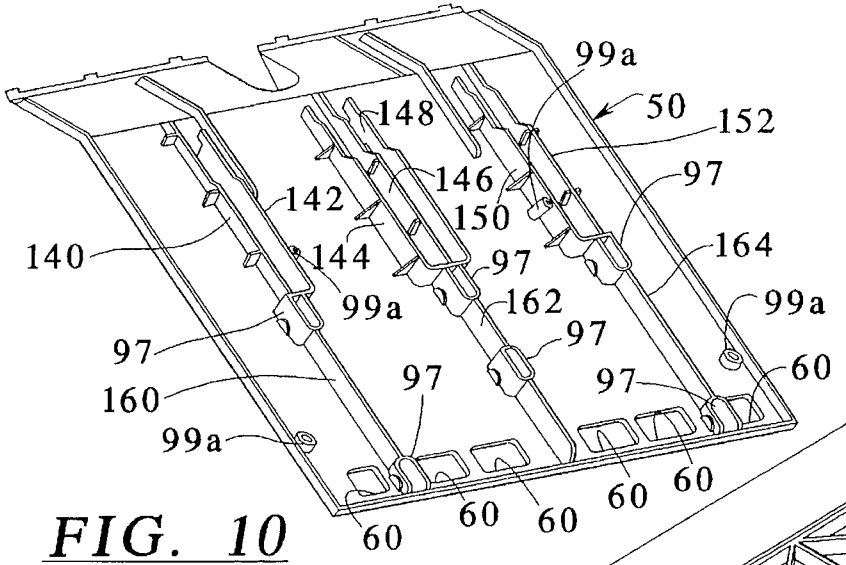
FIG. 10 is a perspective bottom view of the base shown in FIG. 5.

FIG. 10 illustrates the underside structure of the base 50. At a back half of the base are arranged rails 140, 142, 144, 146, 148, 150 and 152. The slot 94*a* (not shown)is between the rails 146, 148; the slot 94*b* (not shown) is between the rails 144, 146; the slot 94*c* (not shown)is between the rails 150, 152 and the slot 94*d* (not shown)is between the rails 140, 142. The anti-tip tab head portion 130*a* rides between the rails 146, 148; the anti-tip tab head portion 132*a* rides between the rails 144, 146; the anti-tip tab head portion 134*a* rides between the rails 140, 142; and the anti-tip tab head portion 136*a* rides between the rails 150, 152, while the platform is being extended. The rails 140–152 provide structural support against the partition 24, as do the cylinders 97 and intermediate rails 160, 162, 164, 166. The rails, by spacing an underside of the base 50 from a top side of the partition 24, form the air channels 57 to the opening 64 between the base 50 and the evaporator cover 26.

Although the present invention has been described with reference to a specific embodiment, those of skill in the art will recognize that changes may be made thereto without departing from the scope and spirit of the invention as set forth in the appended claims.

I claim as my invention:

1. A slidable tray assembly for a refrigerated compartment having a floor structure and an evaporator compartment at a rear of said compartment, comprising:

a base supported on said floor structure and held stationary with respect thereto;

a platform slidably supported on said base, said platform providing platform air holes therethrough, said air holes located at a front of said platform;

said base having an elevated surface providing an air passage therebelow and base air holes at a front of said base for receiving air from said platform air holes, said base air holes communicating air into said air passage, said air passage having an end open into said evaporator compartment.

2. The tray assembly according to claim 1 further comprising a plurality of rollers arranged between said base and said platform to allow sliding movement between said base and said platform.

3. The tray assembly according to claim 1 further comprising at least one removable, generally vertically arranged, back wall portion connected to and extending upwardly from said platform for retaining objects stored on said platform.

4. The tray assembly according to claim 1 wherein said base comprises a plurality of recesses; and said tray assembly further comprising a plurality of rollers, each of said rollers fit into one of said recesses, each roller having an axle, each recess providing a center cavity to allow free rotation of the rollers, and journal cavities to support the axles.

5. The tray assembly according to claim 1 wherein said platform comprises a flat load supporting surface; and side walls, a rear wall and a front wall circumscribing the load supporting surface, said rear wall formed at least in part by a removable panel.

6. A slidable tray assembly for a refrigerated cabinet comprising:

a base mounted to a horizontal surface inside said refrigerated cabinet, said base having a top surface with a longitudinal slot;

a platform mounted slidably to said base, said platform having a load supporting surface;

an anti-tip tab connected to said platform and slidable through said slot, and having means for engaging said base at a forward position to prevent tipping of said platform when extended out beyond said base.

7. The tray assembly according to claim 6 further comprising an air ducting means arranged through said platform to conduct air longitudinally from a front of said platform to a back of said tray assembly.

8. The tray assembly according to claim 7 wherein said air ducting means comprises a first air hole through said platform and a second air hole through said base and an air channel below said top surface of said base, said first and second air holes open to said air channel.

9. The tray assembly according to claim 6 further comprising sliding means applied between said platform and said base for reducing sliding resistance between said platform and said base.

10. The tray assembly according to claim 9 wherein said sliding means comprises a plurality of rollers and said base comprises a plurality of recesses for loosely capturing said rollers between said base and said platform.

11. The tray assembly according to claim 10 wherein said platform comprises longitudinal guide channels for guiding sliding movement of said platform on said rollers.

12. The tray assembly according to claim 6 wherein said platform comprises opposed side walls, a back wall and a front wall, together circumscribing said load supporting surface and said front wall comprises at least one trough region to allow manual wiping of debris from said surface.

13. A slidable tray assembly for a refrigerated cabinet, comprising:

a base mounted to a horizontal surface inside said cabinet, said base having an upper surface elevated from said horizontal surface by rails, a first air hole through the upper surface at a front end thereof, and an air passage between said base and said horizontal surface from said air hole extending backwardly to a rear side of said base; and a platform mounted slidably to said base and having a load supporting surface with a second air hole therethrough at a front end thereof, said second air hole in air flow communication with said first air hole, said platform having means for retaining said platform to said base in an extended position, said means also providing for selectively disconnecting said platform for cleaning.

14. The tray assembly according to claim 13 wherein said platform comprises at least one removable back wall, two opposed sidewalls and a front wall for retaining objects onto said load supporting surface.

15. The tray assembly according to claim 13 further comprising sliding means applied between said platform and said base for reducing sliding resistance between said platform and said base.

16. The tray assembly according to claim 15 wherein said sliding means comprises a plurality of rollers and said base comprises a plurality of recesses for loosely capturing said rollers between said base and said platform.

17. The tray assembly according to claim 16 wherein said platform comprises longitudinal guide channels for guiding sliding movement of said platform on said rollers, and a surface roller mounted to each guide channel at a rear thereof and sized and adapted to roll on said upper surface of said base.

* * * * *